US008220388B2

(12) United States Patent
DeMoore et al.

(10) Patent No.: US 8,220,388 B2
(45) Date of Patent: Jul. 17, 2012

(54) MULTIPLE LAYER ANTI-MARKING JACKETS AND METHODS OF USING IN OFFSET PRINTING

(75) Inventors: Howard W. DeMoore, Dallas, TX (US); Joey V. Le, Arlington, TX (US)

(73) Assignee: Printing Research, Inc., Dallas, TX (US)

( * ) Notice: Subject to any disclaimer, the term of this patent is extended or adjusted under 35 U.S.C. 154(b) by 719 days.

(21) Appl. No.: 12/343,484

(22) Filed: Dec. 24, 2008

(65) Prior Publication Data

US 2010/0154667 A1 Jun. 24, 2010

(51) Int. Cl.
*B41N 6/00* (2006.01)

(52) U.S. Cl. ..... 101/401.1; 101/415.1

(58) Field of Classification Search ..... 101/401.1
See application file for complete search history.

(56) References Cited

U.S. PATENT DOCUMENTS

| | | | | |
|---|---|---|---|---|
| 3,533,355 | A | 10/1970 | Wall | |
| 3,791,644 | A | 2/1974 | DeMoore | |
| 3,835,778 | A | 9/1974 | Bock | |
| 3,960,081 | A * | 6/1976 | Gustavs et al. | 101/424.1 |
| 4,402,267 | A | 9/1983 | DeMoore | |
| 5,046,421 | A | 9/1991 | DeMoore | |
| 5,065,122 | A | 11/1991 | Juskey et al. | |
| 5,396,841 | A * | 3/1995 | Guls | 101/395 |
| 5,511,480 | A | 4/1996 | DeMoore et al. | |
| 5,603,264 | A | 2/1997 | DeMoore et al. | |
| 5,785,105 | A | 7/1998 | Crider et al. | |
| 5,842,412 | A * | 12/1998 | Greenway et al. | 101/420 |
| 5,842,419 | A * | 12/1998 | Puschnerat | 101/483 |
| 5,907,998 | A | 6/1999 | DeMoore et al. | |
| 5,979,322 | A | 11/1999 | DeMoore et al. | |
| 6,073,556 | A | 6/2000 | DeMoore et al. | |
| 6,119,597 | A | 9/2000 | DeMoore et al. | |
| 6,192,800 | B1 | 2/2001 | DeMoore et al. | |
| 6,244,178 | B1 | 6/2001 | DeMoore et al. | |
| 6,647,237 | B2 | 11/2003 | Schlueter, Jr. et al. | |
| 6,901,859 | B2 | 6/2005 | Yokoyama | |
| RE39,305 | E | 9/2006 | DeMoore et al. | |

(Continued)

FOREIGN PATENT DOCUMENTS

EP 1332873 B1 12/2005

OTHER PUBLICATIONS

Foreign Communication From a Related Counterpart Application—International Search Report and Written Opinion, PCT/US2009/068311, Mar. 11, 2010.

(Continued)

*Primary Examiner* — Anthony Nguyen
(74) *Attorney, Agent, or Firm* — Michael W. Piper; Conley Rose, P.C.

(57) ABSTRACT

In a printing press having a transfer cylinder for transferring a freshly printed substrate, an anti-marking device is provided. The anti-marking device comprises an assembly of at least two flexible jackets, the assembly removably attached with free play to the transfer cylinder, wherein an outermost flexible jacket supports the freshly printed substrate as it passes over the transfer cylinder and wherein the outermost flexible jacket is removable from the assembly while the assembly remains attached to the transfer cylinder. In an embodiment, a base cover is attached to the transfer cylinder, and the assembly is removably attached with free play to the transfer cylinder over the base cover.

19 Claims, 8 Drawing Sheets

U.S. PATENT DOCUMENTS

| | | | | |
|---|---|---|---|---|
| 7,270,873 | B2 * | 9/2007 | Rizika et al. | 428/316.6 |
| 7,403,594 | B2 | 7/2008 | Endo et al. | |
| 7,438,115 | B2 | 10/2008 | Bohlen | |
| 7,478,592 | B2 * | 1/2009 | Zahnd et al. | 101/415.1 |
| 2001/0042469 | A1 | 11/2001 | Vosseler | |
| 2002/0155289 | A1 | 10/2002 | Cistone et al. | |
| 2003/0113466 | A1 | 6/2003 | Frazzitta et al. | |
| 2006/0249041 | A1 | 11/2006 | DeMoore et al. | |
| 2008/0026201 | A1 | 1/2008 | Rizika et al. | |
| 2010/0101441 | A1 | 4/2010 | DeMoore et al. | |
| 2010/0154665 | A1 | 6/2010 | DeMoore et al. | |
| 2010/0307357 | A1 | 12/2010 | DeMoore | |

OTHER PUBLICATIONS

Foreign Communication From a Related Counterpart Application—International Preliminary Report on Patentability, PCT/US2009/068311, Jul. 7, 2011.

Foreign Communication From a Related Counterpart Application—International Search Report and Written Opinion, PCT/US2009/061527, Dec. 22, 2009.

Foreign Communication From a Related Counterpart Application—International Preliminary Report on Patentability, PCT/US2009/061527, May 5, 2011.

Office Action Restriction dated Oct. 18, 2011, U.S. Appl. No. 12/343,481, filed on Dec. 24, 2008.

Office Action Restriction dated Sep. 14, 2011, U.S. Appl. No. 12/258,225, filed on Oct. 24, 2008.

DeMoore, Howard, et al., Patent Application entitled "Reversible Anti-marking Jackets and Methods of Using," filed on Sep. 2, 2011, U.S. Appl. No. 13/224,394.

DeMoore, Howard, Patent Application entitled "Apparatus and Method for Adjusting Anti-marking Jackets," filed on Sep. 1, 2010, U.S. Appl. No. 12/874,154.

DeMoore, Howard, Patent Application entitled "Hook to Fabric Fastener Closure Tool," filed on Sep. 24, 2010, U.S. Appl. No. 12/890,393.

DeMoore, Howard, et al., Patent Application entitled "Double-sided Anti-marking Jackets Comprised of Beads and Methods of Using in Offset Printing," filed on Jan. 31, 2011, U.S. Appl. No. 13/018,107.

Office Action dated Dec. 14, 2011, U.S. Appl. No. 12/343,481, filed Dec. 24, 2008.

Office Action dated Dec. 27, 2011, U.S. Appl. No. 12/258,225, filed Oct. 24, 2008.

DeMoore, Howard, et al., Patent Application entitled "Hook to Fabric Fastener Closure Tool," filed on Feb. 29, 2012, U.S. Appl. No. 13/408,887.

Final Office Action dated May 16, 2012, U.S. Appl. No. 12/343,481, filed on Dec. 24, 2008.

Foreign Communication From a Related Counterpart Application—International Search Report and Written Opinion, PCT/US2012/023204, May 10, 2012.

* cited by examiner

MULTIPLE LAYER ANTI-MARKING JACKETS AND METHODS OF USING IN OFFSET PRINTING

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In the operation of a rotary offset printing press, freshly printed substrates, such as sheets or web material, are guided by transfer cylinders or the like from one printing unit to another, and then they are delivered to a sheet stacker or to a sheet folder/cutter unit, respectively. As used herein, the term "transfer cylinder" includes delivery cylinders, transfer rollers, support rollers, support cylinders, delivery wheels, skeleton wheels, segmented wheels, transfer drums, support drums, spider wheels, support wheels, guide wheels, guide rollers, and the like.

The ink marking problems inherent in transferring freshly printed substrates have been longstanding. In order to minimize the contact area between the transfer means and the freshly printed substrate, conventional support wheels have been modified in the form of relatively thin disks having a toothed or serrated circumference, referred to as skeleton wheels. However, those thin disc transfer means have not overcome the problems of smearing and marking the freshly printed substrate due to moving contact between the freshly printed substrate and the projections or serrations. Moreover, the attempts to cover the transfer cylinder with a cover material and/or minimize the surface support area in contact with the freshly printed substrate material often resulted in further problems.

Various efforts have been made to overcome the limitations of thin disk skeleton wheels. One of the most important improvements has been completely contrary to the concept of minimizing the surface area of contact. That improvement is disclosed and claimed in U.S. Pat. No. 3,791,644 to Howard W. DeMoore, incorporated by reference herein in its entirety, wherein the support surface of a transfer cylinder in the form of a wide wheel or cylinder is coated with an improved ink repellent surface formed by a layer of polytetrafluoroethylene (PTFE).

During the use of the PTFE coated transfer cylinders in high-speed commercial printing presses, the surface of the coated cylinders must be washed frequently with a solvent to remove any ink accumulation. Moreover, it has also been determined that the PTFE coated cylinders do not provide a cushioning effect and relative movement, which are beneficial.

The limitations on the use of the PTFE coated transfer cylinders have been overcome with an improved transfer cylinder having an ink repellent, cushioning, and supportive fabric covering or the like for transferring the freshly printed sheet. It is now well recognized and accepted in the printing industry world-wide that marking and smearing of freshly printed sheets caused by engagement of the wet printed surface with the supporting surface of a conventional press transfer cylinder is substantially reduced by using the anti-marking fabric covering system as disclosed and claimed in U.S. Pat. No. 4,402,267 entitled "Method and Apparatus for Handling Printed Sheet Material," the disclosure of which is incorporated herein by reference.

That system, which is marketed under license by Printing Research, Inc. of Dallas, Tex., U.S.A. under the registered trademark SUPER BLUE® includes the use of a low friction coating or coated material on the supporting surface of the transfer cylinder, and over which is loosely attached a movable fabric covering. The fabric covering provided a yieldable, cushioning support for the freshly printed side of the substrate such that relative movement between the freshly printed substrate and the transfer cylinder surface would take place between the fabric covering and the support surface of the transfer cylinder so that marking and smearing of the freshly printed surface was substantially reduced. Various improvements have been made to the SUPER BLUE® system, which are described in more detail in U.S. Pat. Nos. 5,907,998 and 6,244,178 each entitled "Anti-Static, Anti-Smearing Pre-Stretched and Pressed Flat, Precision-Cut Striped Flexible Coverings for Transfer Cylinders"; U.S. Pat. Nos. 5,511,480, 5,603,264, 6,073,556, 6,119,597, and 6,192,800 each entitled "Method and Apparatus for Handling Printed Sheet Material"; U.S. Pat. No. 5,979,322 entitled "Environmentally Safe, Ink Repellent, Anti-Marking Flexible Jacket Covering Having Alignment Stripes, Centering Marks and Pre-Fabricated Reinforcement Strips for Attachment onto Transfer Cylinders in a Printing Press"; and U.S. Pat. No. RE39,305 entitled "Anti-static, Anti-smearing Pre-stretched and Pressed Flat, Precision-cut Striped Flexible Coverings for Transfer Cylinders," each of which is hereby incorporated by reference herein in its entirety. The above cited patents were assigned by Howard W. DeMoore to Printing Research, Inc. of Dallas, Tex., USA and are all owned by Printing Research, Inc.

SUMMARY

In an embodiment, an anti-marking device for use in a printing press having a transfer cylinder for transferring a freshly printed substrate is provided. The anti-marking device comprises an assembly of at least two flexible jackets, the assembly removably attached so that the at least two flexible jackets have free play with respect to the transfer cylinder, wherein an outermost flexible jacket supports the freshly printed substrate as it passes over the transfer cylinder and wherein the outermost flexible jacket is removable from the assembly leaving at least one flexible jacket with free play in the assembly, while the assembly remains attached to the transfer cylinder.

In another embodiment, an anti-marking device for use in a printing press having a transfer cylinder for transferring a freshly printed substrate is provided. The anti-marking device, comprises an assembly of at least two flexible jackets and a base cover, wherein the at least two flexible jackets are coupled to the base cover with free play, and the assembly is removably attached to the transfer cylinder, wherein an outermost flexible jacket supports the freshly printed substrate as it passes over the transfer cylinder and wherein the outermost flexible jacket is removable from the assembly to leave at least one remaining flexible jacket with free play with respect to the base cover, while the assembly remains attached to the transfer cylinder.

In another embodiment, a method of maintaining a printing press having a transfer cylinder is provided. The method comprises removing an outermost flexible jacket from an assembly while the assembly is attached to the transfer cylinder, the assembly initially comprising at least two flexible jackets and a base cover, wherein the assembly is removably attached to the transfer cylinder. After the removal of the outermost flexible jacket, at least one flexible jacket is left and becomes the new outermost flexible jacket. The method further includes returning the printing press to service without performing further action on the assembly.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
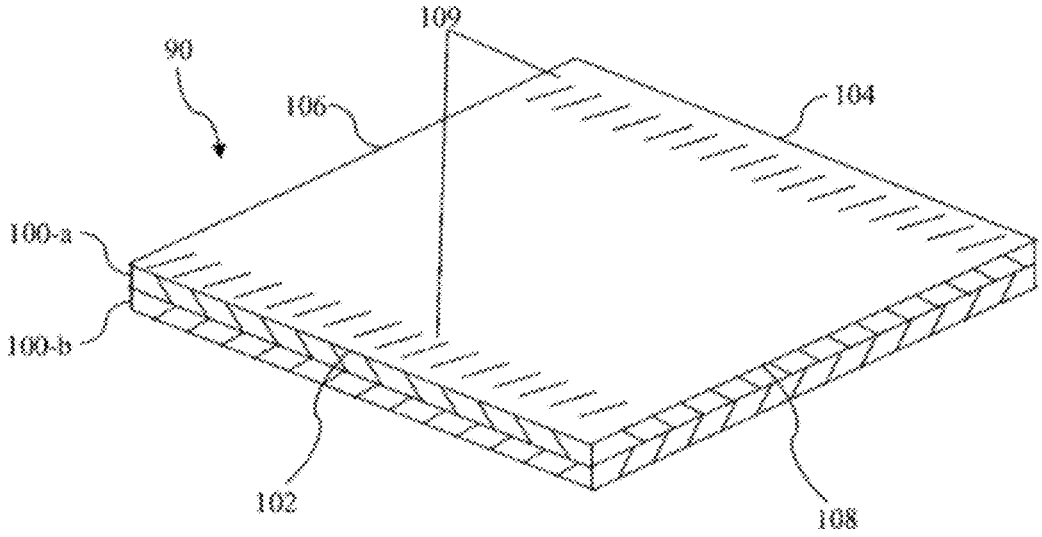
FIG. 1A is an illustration of a multi-layer assembly of anti-marking jackets according to an embodiment of the disclosure.

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

In an embodiment, a transfer cylinder of a printing press may be at least partially enclosed by an assembly comprising a plurality of flexible jackets, wherein the assembly is removably attached to the transfer cylinder. In some contexts, the flexible jackets may be referred to as nets. The flexible jackets may be installed over the transfer cylinder with an amount of free play effective to promote the outermost flexible jacket supporting printed substrates during their passage through the printing press with reduced or minimal marking of the printed substrates, for example marking by smearing or otherwise marring the printing. In one embodiment, the assembly may comprise only flexible jackets and may be attached to the transfer cylinder with an innermost flexible jacket proximate to the transfer cylinder and with no other removable covers intervening between the transfer cylinder and the innermost flexible jacket. Alternatively, the assembly may comprise only flexible jackets but may be attached to the transfer cylinder over a transfer cylinder base cover, wherein the transfer cylinder base cover is separate from the assembly and is removably attached tautly to the transfer cylinder. Transfer cylinder base covers are referred to hereinafter as base covers.

In another embodiment, the assembly may further comprise a base cover which is the innermost layer of the assembly, wherein when the assembly is attached to the transfer cylinder the base cover layer is attached tautly to the transfer cylinder while the flexible jacket layers are attached with free play to the transfer cylinder. In some contexts, the assembly comprising a plurality of flexible jackets, with or without an optional base cover, may be referred to as a multiple layer anti-marking jacket. The flexible jackets may be said to have free play with respect to the transfer cylinder and/or with respect to the base cover.

In an embodiment, the flexible jackets, and optionally the base cover, are non-permanently attached to each other along at least a portion of at least one edge, such that removing the uppermost flexible jacket may not damage the uppermost flexible jacket. It is contemplated that the outermost flexible jacket may be removed from the assembly without releasing the assembly from the transfer cylinder. The flexible jackets may be attached to each other by an adhesive or adhesive tape placed at least along a portion of at least one edge between each of a layer of flexible jackets.

In an embodiment, the flexible jackets, and optionally the base cover, are attached to each other along a portion of at least one edge. Alternatively, the flexible jackets, and optionally the base cover, may be attached to each other along a portion of at least two opposing edges. In an embodiment, the flexible jackets and optionally the base cover may be more strongly attached along a portion of a first edge, for example stitched, and less strongly attached along a portion of a second opposing edge, whereby the less strongly attached edge may readily be lifted to access layers beneath, for example to clean a lower layer. In other embodiments, the flexible jackets, and the optional base cover, may be attached along at least a portion of a third and/or a fourth edge. The flexible jackets, and the optional base cover, may be attached by adhesive, thermal bonding, or combinations thereof. In an embodiment, the flexible jackets, and the optional base cover, may be attached permanently along at least a portion of a first edge, for example sewn along one of a gripper edge and a tail edge.

In an embodiment, the flexible jackets, and the optional base cover, may be attached permanently along at least a portion of a first edge and a second edge, for example sewn along at least a portion of a gripper edge and a tail edge. When removing a flexible jacket that is permanently attached along at least a portion of one or more edges, the flexible jacket may be removed by cutting away using scissors and/or by tearing away. In an embodiment, the assembly comprises two or more flexible jackets, and optionally a base cover. In an embodiment, the assembly comprises three flexible jackets, and optionally a base cover. In an embodiment, the assembly comprises flexible jackets, and optionally a base cover.

When the outermost flexible jacket is worn out or otherwise no longer serviceable, the outermost flexible jacket is removed and the next layer flexible jacket is ready for service. The coupling of a plurality of flexible jackets in the assembly may save time and trouble versus the customary procedure of removing an old flexible jacket, attaching a new flexible jacket, determining proper adjustment and alignment of the new flexible jacket, and returning the printing press to service. Additionally, assembling two or more flexible jackets has provided unanticipated benefits of increased service life, thought to be due to additional cushioning effect of the multiple flexible jackets. Extended wear times have been observed in a test of the assembly having a plurality of flexible jackets. The use of the assembly of two or more flexible jackets may have other advantages, including omitting the use of packing in some printing press operating environments.

Some embodiments of the present disclosure contemplate a flexible jacket comprised of a fabric, wherein the fabric further comprises at least one of cotton, hemp, wool, silk, linen, nylon, rayon, polyester, polyacrylate, polyolefin, polyimide, polyamide, or combinations thereof. Other embodiments of the present disclosure contemplate a flexible jacket comprised of a fluoropolymer. Fluoropolymers contemplated by the present disclosure comprise polytetrafluoroethylene (PTFE), fluorinated ethylene propylene (FEP), and perfluoroalkoxy (PFA). PTFE is sold under the trademark TEFLON available from DuPont Corporation and is sold under the trademark XYLAN available from Whitford. FEP is a copolymer of hexafluoropropylene and tetrafluoroethylene. Flexible jackets comprised of fluoropolymer may provide a variety of advantages in different printing press environments including extended life, greater imperviousness to ink penetration, ease of washing and/or cleaning, and greater resistance to deterioration from exposure to artificial radiation sources. Flexible jackets comprised of fluoropolymer may be able to withstand temperatures of about 400 degrees Fahrenheit, which may allow the use of the flexible jackets comprised of fluoropolymer in a wider range of printing environments. While in the following the description will commonly refer to PTFE, it is understood that in various embodiments other fluoropolymers may be used in the place of PTFE.

In an embodiment, the flexible jacket may be coated with a layer of PTFE on a single surface facing the transfer cylinder or on an inward facing surface and on an outward facing surface. In another embodiment, the flexible jacket may be at least partially woven of threads comprising PTFE. For example the flexible jacket may be woven of a mixture of metallic threads and threads comprising PTFE. As another example, the flexible jacket may be woven of a mixture of colored threads and threads comprising PTFE. In another embodiment, the flexible jacket may be woven of threads that comprise PTFE, for example PTFE coated threads. In another embodiment, the flexible jacket may be woven of threads that are manufactured partly from PTFE, for example a thread manufactured of a composition comprising PTFE and another suitable material, for example materials that promote improved structural strength such as tensile strength of the threads, that promote desirable stiffness and/or flexure strength of the flexible jacket, and/or that provide improved anti-static properties of the threads. In another embodiment, the flexible jacket may be woven of threads consisting essentially of PTFE. In another embodiment, the flexible jacket may be a sheet of continuous PTFE or a sheet mesh of PTFE, for example a sheet of PTFE that has holes or other apertures removed from an otherwise continuous sheet of PTFE.

In an embodiment, the flexible jacket 100 may be woven of threads that comprise in the range from 95 percent to 100 percent fluoropolymer (such as PTFE, FEP, and PFA), in the range from 96 percent to 100 percent fluoropolymer, in the range from 97 percent to 100 percent fluoropolymer, in the range from 98 percent to 100 percent fluoropolymer, in the range from 99 percent to 100 percent fluoropolymer, or in the range from 99.5 percent to 100 percent fluoropolymer. In an embodiment, the flexible Jacket 100 may be woven of threads comprising fluoropolymer (such as PTFE, FEP, and PFA) and from greater than 0 percent up to about 5 percent other material, from greater than 0 percent up to 4 percent other material, from greater than 0 percent up to 3 percent other material, from greater than 0 percent up to 2 percent other material, from greater than 0 percent up to 1 percent other material, from greater than 0 percent up to 0.5 percent other material. The other materials may be selected to promote structural strength of the threads and/or that promote anti-static properties of the threads, for example carbon and polyester.

In an embodiment, the flexible jacket 100 may be woven of threads that comprise in the range from 95 percent to 100 percent PTFE, in the range from 96 percent to 100 percent PTFE, in the range from 97 percent to 100 percent PTFE, in the range from 98 percent to 100 percent PTFE, in the range from 99 percent to 100 percent PTFE, or in the range from 99.5 percent to 100 percent PTFE. In an embodiment, the flexible jacket 100 may be woven of threads comprising PTFE and from greater than 0 percent up to about 5 percent other material, from greater than 0 percent up to 4 percent other material, from greater than 0 percent up to 3 percent other material, from greater than 0 percent up to 2 percent other material, from greater than 0 percent up to 1 percent other material, from greater than 0 percent up to 0.5 percent other material. The other materials may be selected to promote structural strength of the threads and/or that promote anti-static properties of the threads, for example carbon and polyester.

It is understood that in some embodiments other fluoropolymers may be substituted for PTFE in each of the flexible jackets described above. For example, in an embodiment, the flexible jacket may be coated with fluoropolymer, such as PTFE, FEP, and PFA. In an embodiment, the flexible jacket may be at least partially woven of threads comprising fluoropolymer, such as PTFE, FEP, and PFA. In an embodiment, the flexible jacket may be woven of threads that comprise fluoropolymer, for example threads coated with fluoropolymer such as PTFE, FEP, and PFA. In an embodiment, the flexible jacket may be woven of threads that consist essentially of fluoropolymer, for example threads that consist essentially of PTFE, FEP, and PFA. Further details about flexible jackets comprised of fluoropolymer may be found in U.S. patent application Ser. No. 12/343,481 filed Dec. 24, 2008 entitled "Anti-marking Jackets Comprised of Fluoropolymer and Methods of Using in Offset Printing," by Howard W. DeMoore et al., which is hereby incorporated by reference in its entirety.

In an embodiment, different flexible jackets making up the multi-layer assembly or stack may have different compositions. For example, in an embodiment, the outermost and innermost layer of flexible jackets in the assembly may be comprised of fluoropolymer while the middle flexible jackets may be comprised of other fibers, such as cotton. In another embodiment, alternate layers of flexible jackets may alternate between fluoropolymer composition and cotton composition. For example, a first flexible jacket layer may be comprised of fluoropolymer, a second flexible jacket layer may be comprised of cotton, a third flexible jacket layer may again be comprised of fluoropolymer, a fourth flexible jacket layer may again be comprised of cotton, and so on. In another embodiment, the outermost and innermost layer of flexible jackets in the assembly may be woven of threads comprised of fluoropolymer and from greater than 0 percent up to about 5 percent other material and/or materials while the middle layers of flexible jackets in the assembly may be woven of threads coated with fluoropolymer. A diverse set of combinations of material compositions of the flexible jackets is contemplated by the present disclosure. The selection of different compositions of flexible jackets for different layers may promote reduced cost and/or increased wear and/or improved performance of the assembly in printing operations.

In an embodiment, the flexible jackets of the assembly are intended to provide a yieldable, cushioning support for the freshly printed side of a substrate. To achieve this yieldable, cushioning support it is desirable that the flexible jackets be installed and/or adjusted to have an effective amount of slack, looseness, and/or free play with respect to the base cover and/or the transfer cylinder. In an embodiment, the flexible jackets may be provided with means for visual alignment to promote adjustment of the effective amount of free play of the flexible jackets. In another embodiment, however, the flexible jackets may not have means for visual alignment. For further details about visual alignment means in the flexible jacket and/or the base cover, see U.S. patent application Ser. No. 12/258,225 filed Oct. 24, 2008, and entitled "Offset Printing Transfer Cylinder Base Cover with Alignment Stripes for Precision Installation of a Flexible Jacket Cover also with Alignment Stripes" by Howard DeMoore, which is hereby incorporated by reference in its entirety.

The optional means for visual alignment on the flexible jackets singly or in combination with a base cover having means for visual alignment, may promote repeatable adjustments based on experience. Additionally, the optional means for visual alignment on the flexible jackets and the optional means for visual alignment on the base cover (when a base cover is employed), singly or in combination, may promote ease of conveying instructions from a first experienced press operator to a second less experienced or inexperienced press operator, for example from a remote support center via a telephone call. In some embodiments, a the assembly comprising flexible jackets with means for visual alignment may be installed over the transfer cylinder with no intervening base cover, and in this case the visual alignment means on the flexible jackets may be used on their own to promote adjustment of an effective amount of free play.

In an embodiment, a plurality of means for visual alignment may be disposed horizontally on the base cover, for example a base cover installed over the transfer cylinder wherein the assembly is installed over the base cover or a base cover comprising the assembly. As used herein, horizontal indicates that the means for visual alignment on the base cover are substantially parallel to the axis of the transfer cylinder when the base cover is installed over the transfer cylinder. In an embodiment, the means for visual alignment on the base cover are set off from each other at substantially equal distances, for example by about ¾ inch (about 1.9 cm). In other embodiments, however, the means for visual alignment on the base cover may be set off from each other at equal distances but different from about ¾ inch (about 1.9 cm). In an embodiment, a plurality of means for visual alignment may be disposed horizontally on the flexible jacket. As used herein, horizontal indicates that the means for visual alignment on the flexible jacket are substantially parallel to the axis of the transfer cylinder when the flexible jacket is installed over the transfer cylinder. In an embodiment, the means for visual alignment on the flexible jacket are set off from each other at substantially equal distances, for example by about ¾ inch (about 1.9 cm). In other embodiments, however, the means for visual alignment on the flexible jacket may be set off by equal distances but different from about ¾ inch (about 1.9 cm). In other embodiments, the means for visual alignment may be offset by about the same amount for both the base cover and the flexible jacket. The means for visual alignment, of both and/or either of the base cover and the flexible jacket, may be continuous or interrupted. The means for visual alignment may extend horizontally substantially across the whole of the base cover and/or flexible jacket. Alternatively, the means for visual alignment may extend only partially horizontally across the base cover and/or flexible jacket.

The optional means for visual alignment on the base cover may be referred to as visual stripes. The visual stripes on the base cover may be applied as a line segment or a series of line segments (e.g., a dotted line) on the base cover, for example by painting, by lithography, by silk screening, and/or by laser induced marking or scoring, to positively define visual stripes horizontally disposed on the base cover. In another embodiment, different colored threads may be employed to positively define visual stripes horizontally disposed on the base cover. For example, the visual stripes may be defined by periodically weaving in one or more threads having a color that contrasts with the color of the majority of threads making up the woven material of the base cover. In another embodiment, the visual stripes may be defined by periodically weaving in one or more threads having a different diameter than the majority of threads making up the woven material of the base cover. In another embodiment, the base cover may be woven in a lattice pattern that creates substantially horizontal visual stripes in the base cover material, for example a herringbone pattern, a checkerboard pattern, a basket weave pattern, and other lattice patterns. The woven material may be constructed of natural fibers and/or synthetic fibers.

Alternatively, the visual stripes on the base cover may be provided by omitting one or more threads from the woven material of the base cover, for example by omitting one or more weft threads or by omitting one or more warp threads from a woven base cover. Removing one or more threads from a woven base cover may be said to negatively define visual stripes. The absence of threads from the woven base cover may be discerned by a print operator by seeing a greater portion of the underlying transfer cylinder through the base cover at the location of the missing threads, for example when the transfer cylinder is a bright metal material such as stainless steel. In some embodiments, a backing strip or backing sheet may be adhered to one side of the base cover to promote discernment by a print operator of the visual stripes. Alternatively, a packing sheet that promotes discernment of the visual stripes may be placed around the transfer cylinder beneath the base cover. The backing strips, backing sheet, and/or packing sheet may have a yellow color, an orange color, a red color, or other color which can be more readily discerned through the negatively defined visual stripe. The backing strips, backing sheet, and/or packing sheet may be a shiny, metallic material. In an embodiment, the transfer cylinder may be painted a color that promotes discernment of the visual stripes by a print operator.

Likewise, the optional means for visual alignment on the flexible jacket may be provided as for the base cover. The means for visual alignment on the flexible jacket may be referred to as visual stripes. The visual stripes on the flexible jacket may be applied as a line segment or a series of line segments (e.g., a dotted line) on the flexible jacket, for example by painting, by lithography, by silk screening, and/or by laser induced marking or scoring, to positively define visual stripes horizontally disposed on the flexible jacket. In another embodiment, different colored threads may be employed to positively define visual stripes horizontally and/or vertically disposed on the flexible jacket. In another embodiment, different diameter threads may be employed to positively define visual stripes horizontally disposed on the flexible jacket. In another embodiment, the flexible jacket may be woven in a lattice pattern that creates substantially horizontal visual stripes in the flexible jacket woven material, for example a herringbone pattern, a checkerboard pattern, a basket weave pattern, and other lattice patterns.

Alternatively, the visual stripes on the flexible jacket may be provided by omitting one or more threads from the woven material of the flexible jacket, for example by omitting one or more weft threads or by omitting one or more warp threads from a woven flexible jacket. Removing one or more threads from a woven flexible jacket may be said to negatively define visual stripes. The absence of threads from the woven flexible jacket may be discerned by a print operator by seeing the base cover through the flexible jacket, for example by seeing a visible stripe on the base cover through the flexible jacket at the area of the missing thread, or by seeing the transfer cylinder through the flexible jacket at the area of the missing thread.

Turning now to FIG. 1A, a first assembly 90 is described. The first assembly 90 comprises a first flexible jacket 100-*a* and a second flexible jacket 100-*b*. The first assembly 90 and the flexible jackets 100 have a gripper edge 102 and a tail edge 104 opposing the gripper edge 102. The first assembly 90 and the flexible jackets 100 have an operator edge 106 and a gear edge 108 opposing the operator edge 106. The flexible jackets 100 may be coupled and/or attached to each other to form the first assembly 90 by any of a variety of means including stitching, adhesive, thermal bonding, crimp strips, male-female fasteners, brads, rivets, tension strips, staples, or combinations thereof In an embodiment, the flexible jackets 100 may be attached along at least a portion of one of the gripper edge 102 and the tail edge 104 while the opposing edge remains loose. In an embodiment, the flexible jackets 100 may be attached along portions of both of the gripper edge 102 and the tail edge 104. In another embodiment, the flexible jackets 100 may be attached along portions of additional edges. It is understood that the flexible jackets 100 are not attached to each other in the interior of their substantially rectangular forms but are free to move relatively freely from each other at least in this interior area. While the flexible jackets 100 are illustrated as attached using adhering tape 109, in other embodiments other means of attachment may be used.

Figure 1B:
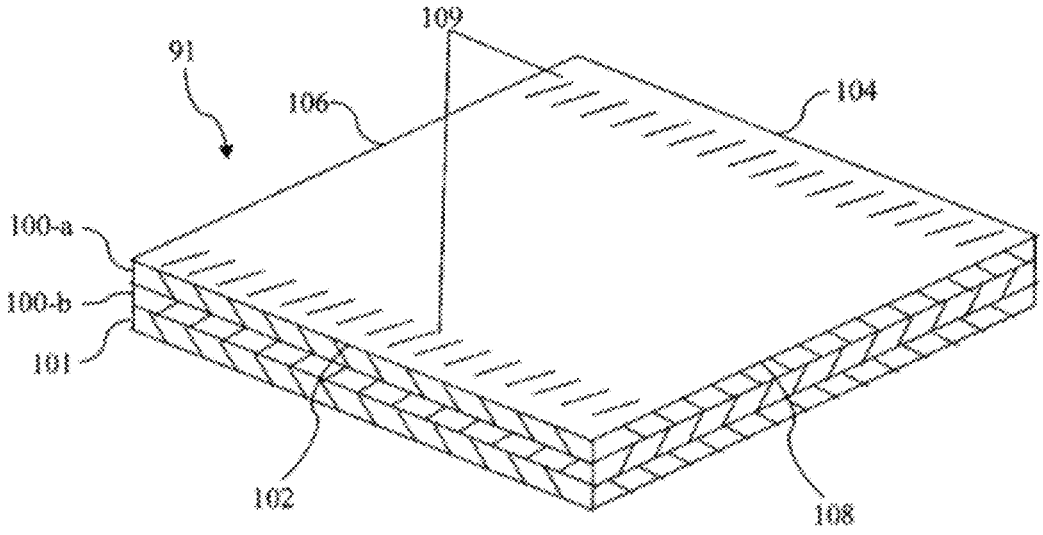
FIG. 1B is an illustration of a multi-layer assembly of anti-marking jackets and a transfer cylinder base cover according to an embodiment of the disclosure.

Turning now to FIG. 1B, a second assembly 91 is described. The second assembly 91 comprises the first flexible jacket 100-*a*, the second flexible jacket 100-*b*, and a base cover 101. The second assembly 91, the flexible jackets 100, and the base cover 101 have a gripper edge 102 and a tail edge 104 opposing the gripper edge 102. The second assembly 91, the flexible jackets 100, and the base cover 101 have an operator edge 106 and a gear edge 108 opposing the operator edge 106. When the second assembly 91 is installed on a transfer cylinder, the second assembly 91 may be oriented with the base cover 101 next to the transfer cylinder. In an embodiment, the base cover 101 may comprise an outward facing surface (e.g., the surface faces outwards from the transfer cylinder when the second assembly 91 is installed over the transfer cylinder) encrusted with glass beads and/or ceramic beads that are adhered to the base cover 101. The surface encrusted with glass and/or ceramic beads in an embodiment may be coated and/or covered with silicone, fluoropolymer, and/or other material effective to reduce friction. The bead encrusted base cover 101 may be relatively thinner than other base covers. In an embodiment, for example, the bead encrusted base cover 101 may be about 5 thousandths (0.005) inch (about 0.127 mm) thick. The bead encrusted base cover 101 may provide benefits in some press units with limited clearance. In other embodiments, however, the bead encrusted base cover 101 may have different thickness, depending on the size of the beads.

The flexible jackets 100 and the base cover 101 may be coupled and/or attached to each other to form the second assembly 91 by any of a variety of means including stitching, adhesive, thermal bonding, crimp strips, male-female fasteners, brads, rivets, tension strips, staples, or combinations thereof. In an embodiment, the flexible jackets 100 and the base cover 101 may be attached along at least a portion of one of the gripper edge 102 and the tail edge 104 while the opposing edge remains loose. In an embodiment, the flexible jackets 100 and the base cover 101 may be attached along portions of both of the gripper edge 102 and the tail edge 104. In another embodiment, the flexible jackets 100 and the base cover 101 may be attached along portions of additional edges.

While the flexible Jackets 100 and the base cover 101 are illustrated as attached using adhering tape 109, in other embodiments other means of attachment may be used. It is understood that the flexible jackets 100 and base cover 101 are not attached to each other in the interior of their substantially rectangular forms but are free to move relatively freely from each other at least in this interior area. Additionally, it is understood that the flexible jackets 100 and the base cover 101 are coupled so as to promote at least the outer flexible jacket 100 having free play relative to the base cover 101 when the second assembly 91 is attached to the transfer cylinder of a printing unit.

In an embodiment, the second assembly 91 may be installed over the transfer cylinder of a printing unit with the base cover 101 closest to the transfer cylinder and with the first flexible jacket 100-*a* furthest from the transfer cylinder and/or outermost. In an embodiment, the base cover 101 may have a bottom face and a top face, wherein the bottom face is oriented towards the transfer cylinder and the upper face is oriented outwards from the transfer cylinder and/or towards the second flexible jacket 100-*b*. In an embodiment, the top face of the base cover 101 may be a low friction surface. In another embodiment, however, the base cover 101 may have substantially similar surfaces on its bottom face and its upper face.

Figure 2A:
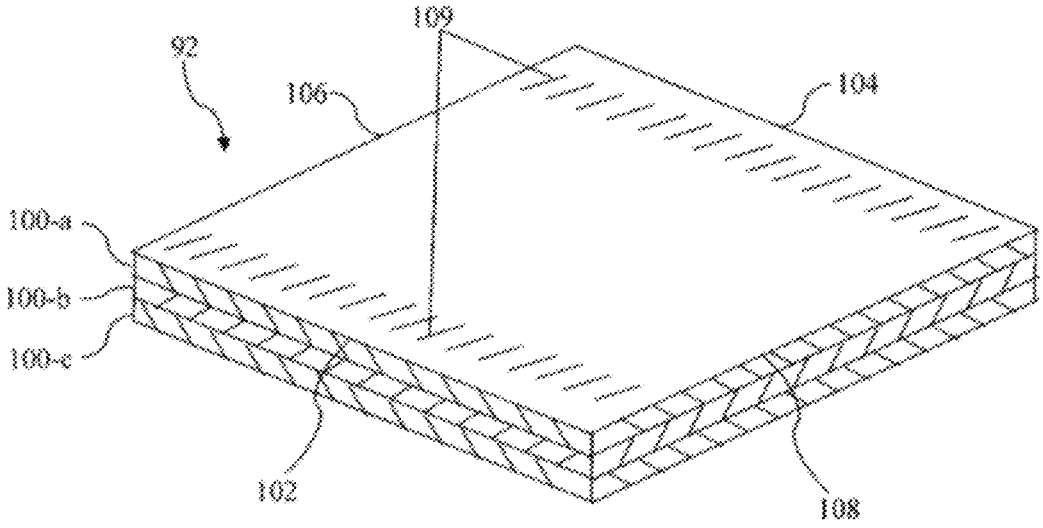
FIG. 2A is an illustration of a multi-layer assembly of anti-marking jackets according to an embodiment of the disclosure.
Figure 2B:
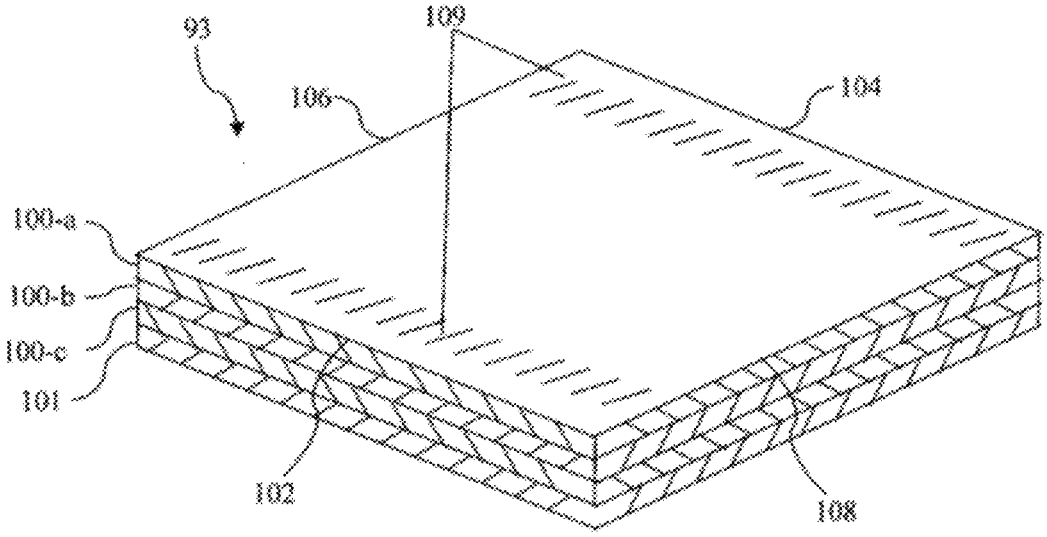
FIG. 2B is an illustration of a multi-layer assembly of anti-marking jackets and a transfer cylinder base cover according to an embodiment of the disclosure.
Figure 3A:
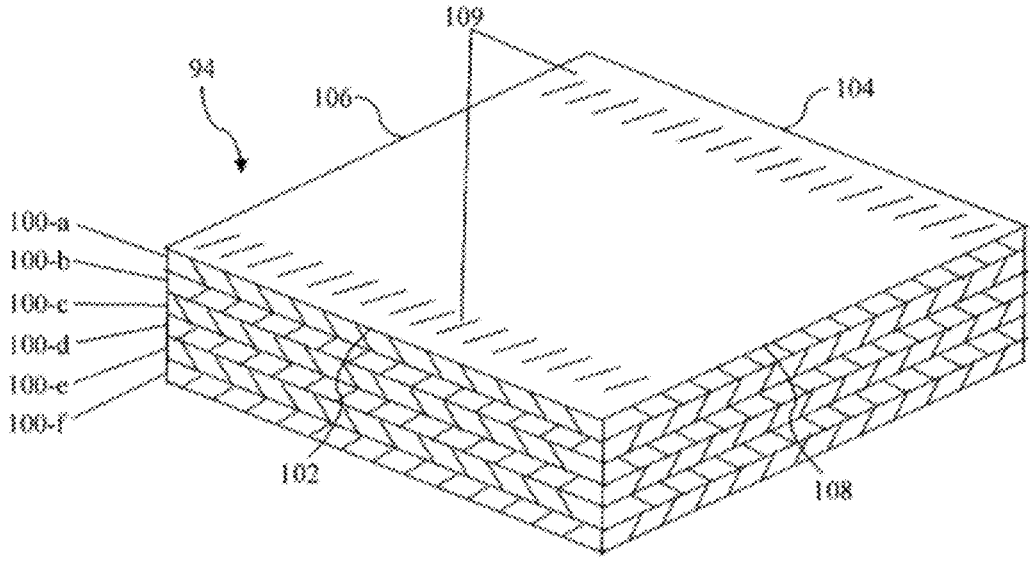
FIG. 3A is an illustration of a multi-layer assembly of anti-marking jackets according to an embodiment of the disclosure.
Figure 3B:
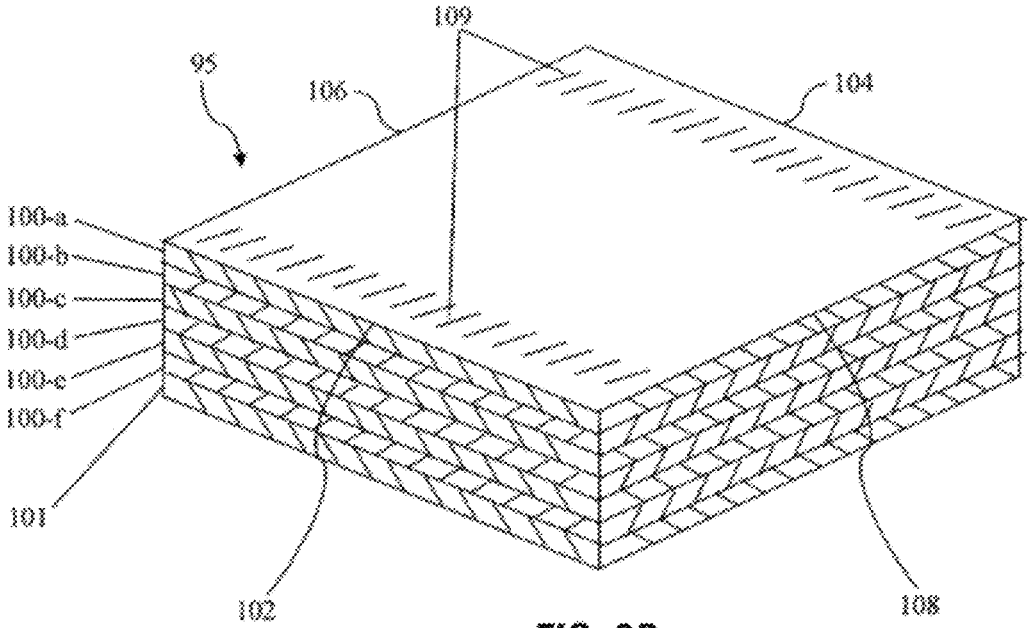
FIG. 3B is an illustration of a multi-layer assembly of anti-marking jackets and a transfer cylinder base cover according to an embodiment of the disclosure.

Turning now to FIG. 2A, a third assembly 92 is described. The third assembly 92 is substantially similar to the first assembly 90, with the difference that the third assembly 92 comprises a third flexible jacket 100-*c*. Turning now to FIG. 2B, a fourth assembly 93 is described. The fourth assembly 93 is substantially similar to the second assembly 91, with the difference that the fourth assembly comprises the third flexible jacket 100-*c*. Turning now to FIG. 3A, a fifth assembly 94 is described. The fifth assembly 94 is substantially similar to the third assembly 92, with the difference that the fifth assembly 94 comprises a fourth flexible jacket 100-*d*, a fifth flexible jacket 100-*e*, and a sixth flexible jacket 100-*f*. Turning now to FIG. 3B, a sixth assembly 95 is described. The sixth assembly 95 is substantially similar to the fourth assembly 93, with the difference that the sixth assembly comprises the fourth flexible jacket 100-*d*, the fifth flexible jacket 100-*e*, and the sixth flexible jacket 100-*f*.

While assemblies 90, 91, 92, 93, 94, and 95 comprising two flexible jackets 100, three flexible jackets, and six flexible jackets, comprising an optional base cover 101, were illustrated and described, it is understood that other assemblies of flexible jackets 100 and the optional base cover 101 are contemplated by the present disclosure, for example assemblies comprising four flexible jackets 100, assemblies comprising five flexible jackets 100, and assemblies comprising more than six flexible jackets 100, each with or without an optional base cover 101. It is understood that the figures FIG. 1A through FIG. 3B do not represent the dimensions of the assemblies 90-95 to scale. The thickness of individual flexible jackets 100 may be in the range from about 4 thousandths (0.004) inch (about 0.102 mm) to about 10 thousandths (0.010) inch (about 0.254 mm) and the thickness of the optional base cover 101 may be in the range from about 7 thousandths (0.007) inch (about 0.178 mm) to about 14 thousandths (0.014) inch (0.356 mm), while the rectangular dimensions of the individual flexible jackets 100 are on the order of at least inches by inches. The several embodiments illustrated in FIG. 1A, FIG. 1B, FIG. 2A, FIG. 2B, FIG. 3A, and FIG. 3B may have different advantages and price points that make them suitable in different operating environments. A consideration in some printing presses is the clearance between the transfer cylinder and other rotating cylinders and/or wheels, for example an impression cylinder. A consideration in some printing press businesses is the volume of substrates printed by the printing press.

Other alternative configurations of assembly 90-95 will be readily apparent to those skilled in the art based upon the description herein, and these alternative configurations are also contemplated by the present disclosure. Other embodiments of flexible jackets 100 useful in practicing the present invention are disclosed in U.S. Pat. Nos. 5,907,998; 5,979,322; 6,119,597; and 6,244,178, referenced previously and owned by Printing Research Inc. of Dallas, Tex., U.S.A.

Figure 4A:
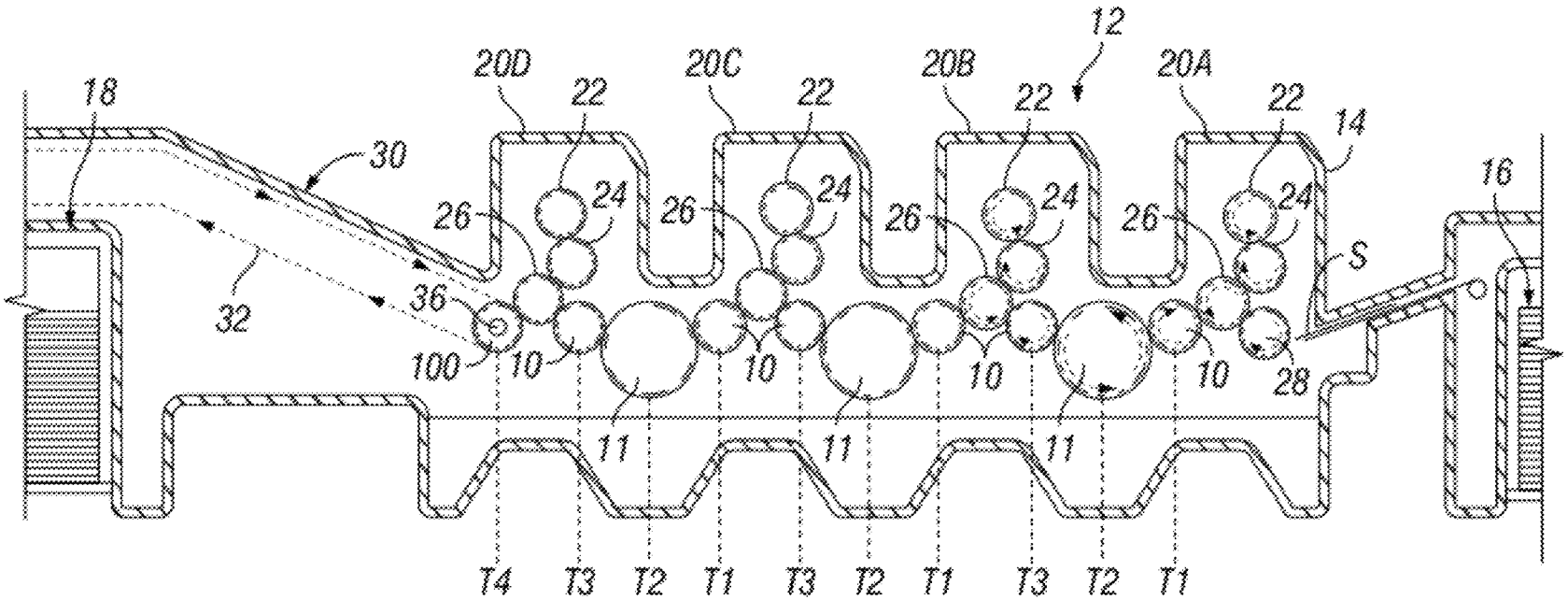
FIG. 4A (Prior Art)
FIG. 4A is a schematic side elevational view showing multiple transfer cylinders installed at substrate transfer positions in a four color rotary offset printing press of a type made by Heidelberg Druckmaschinen Aktiengesellschaft.
Figure 4B:
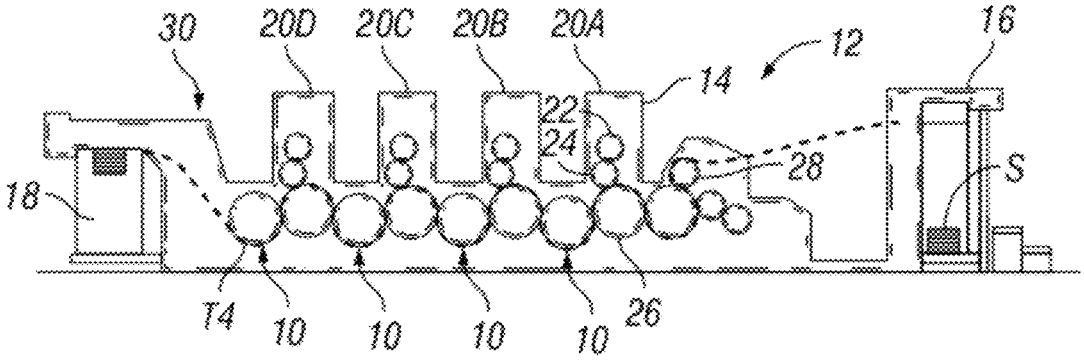
FIG. 4B (Prior Art)
FIG. 4B is a schematic side elevational view showing multiple transfer cylinders installed at substrate transfer positions in a four color rotary offset printing press of the Lithrone Series made by Komori Corp.

For exemplary purposes, the assembly 90-95 will be described with reference to the processing of sheet substrates. However, it will be understood that the principles of the disclosure are equally applicable to web substrates. The assembly 90-95, optionally in combination with a base cover 101 installed over the transfer cylinder 10, may be used in combination with high-speed printing press equipment of the type used, for example, in offset printing. FIG. 4A shows a typical, four color offset printing press of the type made by Heidelberg Druckmascbinen Aktiengesellschaft, and FIG. 4B shows a four color offset printing press of the Lithrone Series available from Komori Corp. Referring to FIGS. 4A and 4B, such equipment includes one or more transfer cylinders 10 for handling a processed substrate, such as a freshly printed sheet between printing units and upon delivery of the printed sheet to a delivery stacker. The assembly 90-95 and the optional base cover 101 are installed on transfer cylinders 10. As used herein, the term "processed" refers to various printing methods, which may be applied to either side or both sides of a substrate, including the application of aqueous inks, protective coatings and decorative coatings. The term "substrate" refers to sheet material or web material.

Use of the present disclosure, in combination with the transfer cylinder 10 at an interstation transfer position (T1, T3) or at a delivery position (T4) in a typical rotary offset printing press 12, is believed to be readily understandable to those skilled in the art. In any case, reference may be made to my earlier U.S. Pat. Nos. 3,791,644 and 4,402,267, which disclose details regarding the location and function of a sheet support cylinder in a typical multistation printing press 12. The present disclosure may, of course, be utilized with conventional printing presses 12 having any number of printing units 20 or stations.

Referring to FIGS. 4A and 4B, the printing press 12 includes a press frame 14 coupled on its input end to a sheet feeder 16 from which sheets, herein designated S, are individually and sequentially fed into the press. At its delivery end, the printing press 12 is coupled to a sheet stacker 18 in which the printed sheets are collected and stacked. Interposed between the sheet feeder 16 and the sheet stacker 18 are four substantially identical sheet printing units 20A, 20B, 20C, and 20D which are capable of printing different color inks onto the sheets as they are transferred through the printing press 12.

As illustrated in FIGS. 4A & 4B, each printing press 12 is of conventional design, and includes a plate cylinder 22, a blanket cylinder 24, and an impression cylinder 26. Freshly printed sheets S from the impression cylinder 26 are transferred to the next printing unit 20 by a transfer cylinder 10. The initial printing unit 20A is equipped with a sheet in-feed roller 28 which feeds individual sheets one at a time from the sheet feeder 16 to the initial impression cylinder 26. In an embodiment, the transfer cylinder 10 may be painted a color that promotes discernment of negatively defined visual stripes in the optional base cover by a print operator.

The freshly printed sheets S are transferred to the sheet stacker 18 by a delivery conveyor system, generally designated 30. The delivery conveyor system 30 is of conventional design and includes a pair of endless delivery gripper chains 32 carrying transversely disposed gripper bars, each having gripper elements for gripping the leading edge of a freshly printed sheet S as it leaves the impression cylinder 26 at the delivery position T4. As the leading edge of the printed sheet S is gripped by the grippers, the delivery gripper chains 32 pull the gripper bars and sheet S away from the impression cylinder 26 and transport the freshly printed sheet S to the sheet delivery stacker 18.

Referring to FIG. 4A, an intermediate transfer cylinder 11 receives sheets printed on one side from the transfer cylinder 10 of the preceding printing unit 20. Each intermediate transfer cylinder 11, which is of conventional design, typically has a diameter twice that of the transfer cylinder 10, and is located between two transfer cylinders 10, at interstation transfer positions T1, T2 and T3, respectively. The impression cylinders 26, the intermediate transfer cylinders 11, the transfer cylinders 10, as well as the sheet in-feed roller 28, are each provided with sheet grippers which grip the leading edge of the sheet to pull the sheet around the cylinder in the direction as indicated by the associated arrows. The transfer cylinder 10 in the delivery position T4 is not equipped with grippers, and includes instead a large longitudinal opening A, which provides clearance for passage of the chain driven delivery conveyor gripper bars. In some printing press installations, an artificial radiation source, for example an ultraviolet lamp and/or an infrared lamp, may be mounted to radiate semi-directly or directly onto the interstation transfer positions T1, T2, and T3. The artificial radiation may be employed to cure and/or set the wet ink or coating on printed substrates as they pass through the printing press 12.

Figure 5:
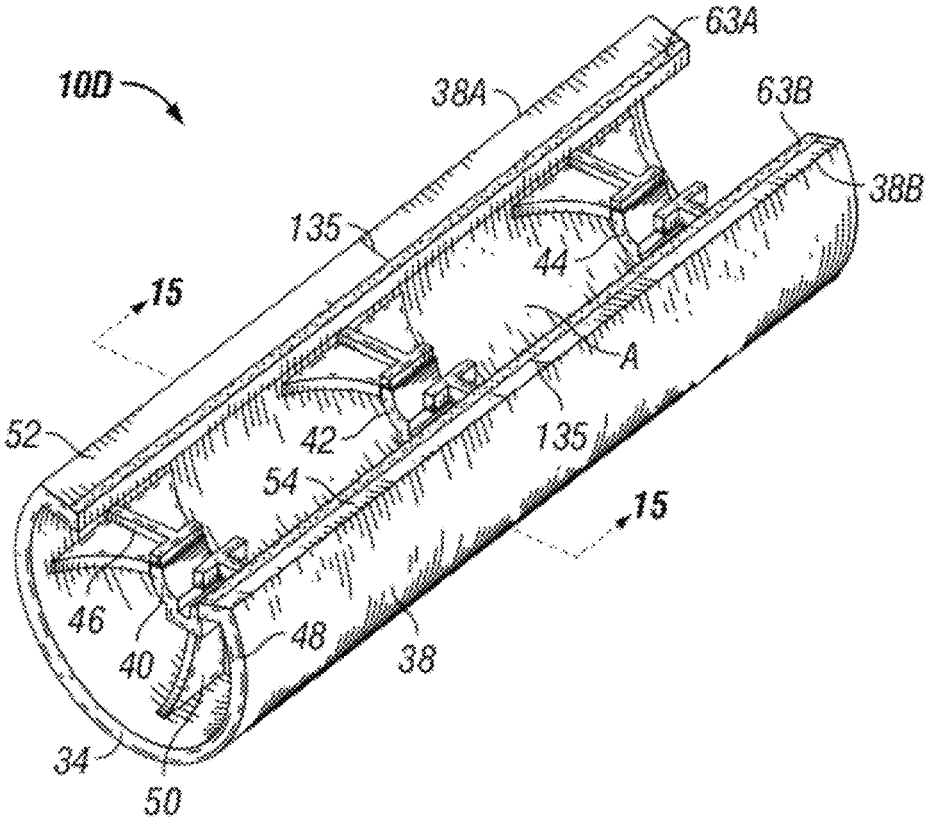
FIG. 5 (Prior Art)
FIG. 5 is a perspective view of a transfer cylinder of a type commonly used on printing presses made by Heidelberg Druckmaschinen Aktiengesellschaft.
Figure 6A:
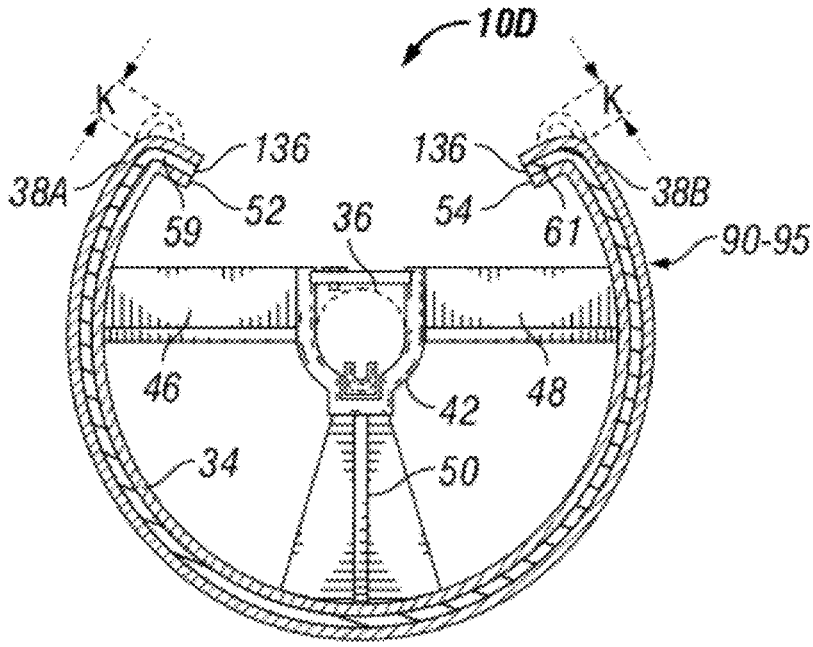
FIG. 6A is a cross-sectional view of a transfer cylinder taken along line 15-15 of FIG. 3 having an integrated, anti-marking cover installed thereon.

Referring now to FIGS. 5 and 6A, a preferred transfer cylinder 10D is shown for use with the Heidelberg printing press 12 of FIG. 4A. The assembly 90-95 described herein above are installed on a transfer cylinder 10D on the last printing unit 20D of the printing press 12 in the delivery position (T4) and has a cylindrical rim 34, which is supported for rotation on the press frame 14 by a rotatable delivery shaft 36. The external cylindrical surface 38 of the cylindrical rim 34 has a gap "A" extending longitudinally along the length of the transfer cylinder 10D and circumferentially between gripper edge 38A and tail edge 38B, respectively. The transfer cylinder 10D is attached to the delivery shaft 36 by longitudinally spaced hubs 40, 42 and 44. Additionally, center alignment marks 135 are formed on the cylinder flanges portions 52, 54 and on the external cylindrical surface 38 of the cylindrical rim 34, as shown in FIG. 3. The purpose of the center alignment marks 135 is to facilitate the precise alignment and attachment of the assembly 90-95 and/or the base cover 101 to the transfer cylinder 10. In an embodiment, a center alignment mark 135 may also be provided on the assembly 90-95 and/or the optional base cover. The center alignment mark 135 may be distinguished from the visible stripes at least by the fact that the center alignment mark 135 is substantially perpendicular to the axis of the transfer cylinder 10 while the visible stripes are substantially parallel to the axis of the transfer cylinder 10.

The hubs 40, 42, and 44 are connected to the cylindrical rim 34 by webs 46, 48 and 50, and support the transfer cylinder 10D for rotation on the delivery shaft 36 of the printing press 12 in a manner similar to the mounting arrangement disclosed in U.S. Pat. No. 3,791,644. In the embodiment shown in FIG. 5, the delivery cylinder 10D includes opposed cylinder flanges 52, 54, which extend generally inwardly from the surface of the cylindrical rim portion 34. The flanges 52 and 54 include elongated flat surfaces for securing the assembly 90-95 and the optional base cover 101 as described below. As described herein, transfer cylinders 10 may have alternative configurations for accommodating the various means for releasably attaching the assembly 90-95 and the optional base cover to the transfer cylinder 10 as described herein.

Figure 6B:
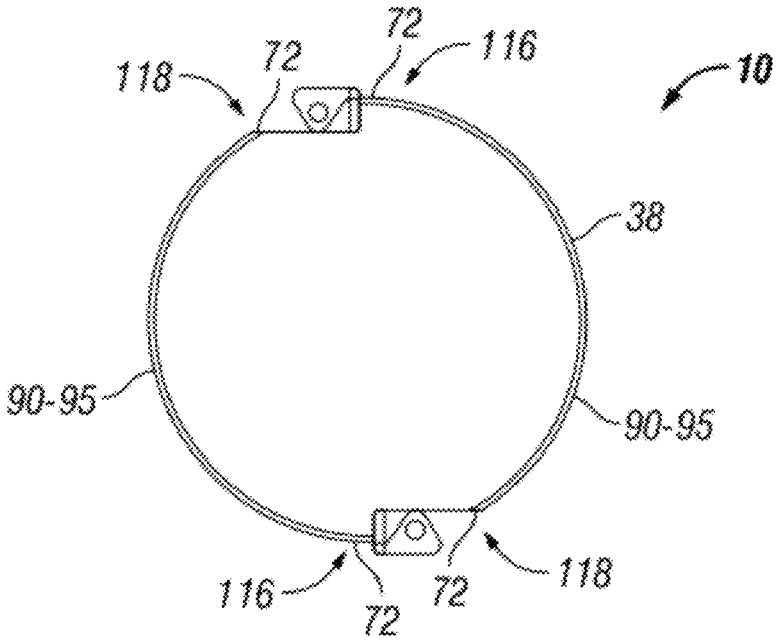
FIG. 6B is a cross-sectional view of a transfer cylinder of a type commonly used on Lithrone Series printing presses made by Komori Corp.

Referring to FIG. 6B, a cross-sectional view of preferred transfer cylinder 10 is shown for use with the Lithrone Series printing press of FIG. 4B. Transfer cylinder 10 is designed and configured to accept a pair of assemblies 90-95, with a first assembly 90-95 covering about one-half of the cylindrical surface 38 of the transfer cylinder 10 and a second assembly 90-95 covering about the remaining one-half of the cylindrical surface 38. The assembly 90-95 is releasably attached to the transfer cylinder 10 at the jacket tail edge and the jacket gripper edge with flat clamp bar 72 held in place with a series of spring loaded screws spaced along the length of the clamp bar 72. In some cases, the assembly 90-95 is attached by various means including, but not limited to, hook and loop fabric material such as VELCRO that mates adheringly to the assembly 90-95, an adhesive strip or tape, and other adhering means. In some embodiments where hook and loop fabric material is used to attach the assembly 90-95 to the transfer cylinder 10, the height of the hook and loop fabric material may be increased based on the thickness of the assembly 90-95, for example thicker for assemblies 94 and 95 than for assemblies 90 and 91. For example, the adhesive strip may be coupled on one side to the assembly 90-95 through one of a heating process, a pressure process, or both (e.g., ironing). In embodiment, a portion of the adhesive strip may be extruded through an edge of the assembly 90-95 to couple the adhesive strip to the assembly 90-95. For example, the extruded portion of the adhesive strip may form end caps or structures like rivets on the opposite side of the assembly 90-95 to secure the adhesive strip to the assembly 90-95. The extruded portion of the adhesive strip may partially form an interlocking matrix on the opposite side of the assembly 90-95 to secure the adhesive strip to the assembly 90-95. In an embodiment, a portion of the assembly 90-95 along the edge may be abraded to provide a more suitable mating surface for coupling to a hook and loop fastener, for example VELCRO. In an embodiment, the assembly 90-95 may be fabricated from precision cut flexible jackets 100 and optional base cover 101 to promote simple installation and proper free play without adjustment. It is contemplated that the assembly 90-95, taught by the present disclosure, may provide extended usage cycles relative to known designs for flexible jackets.

The function and operation of the transfer cylinders 10 and associated grippers of the printing presses 12 are believed to be well known to those familiar with multi-color sheet fed presses, and need not be described further except to note that the impression cylinder 26 functions to press the sheets against the blanket cylinders 24 which applies ink to the sheets, and the transfer cylinders 10 guide the sheets away from the impression cylinders 26 with the wet printed side of each sheet facing against the support surface of the transfer cylinder 10. Since each transfer cylinder 10 supports the printed sheet with the wet printed and/or coated side facing against the transfer cylinder support surface, the transfer cylinder 10 is provided with the assembly 90-95 and the optional base cover 101 as described herein. The assembly 90-95 and the optional base cover 101 are releasably attached to the transfer cylinder 10 by means for releasably attaching the assembly 90-95 and the optional base cover 101 to a transfer cylinder 10. In an embodiment shown in FIG. 6A, the assembly 90-95 is connected to the transfer cylinder flanges 52 and 54 by the hook and loop (i.e., VELCRO) fastener strips 59, 61. Alternatively, the assembly 90-95 may be, at least partially, connected to the transfer cylinder using adhesive strip, as described above. In an embodiment shown in FIG. 6A, the assembly 90-95 may be attached to the transfer cylinder flanges 52 and 54 by mechanical mechanisms, for example by mechanical fasteners such as screws; mechanical take up reels or any other forms of mechanical roll up bars (often referred to collectively as reel cylinders); and the like. Upon installation of the assembly 90-95 and the optional base cover 101, at least the outermost flexible jacket 100 is movable relative to the transfer cylinder 10 and the optional base cover 101 as described previously.

Figure 7:
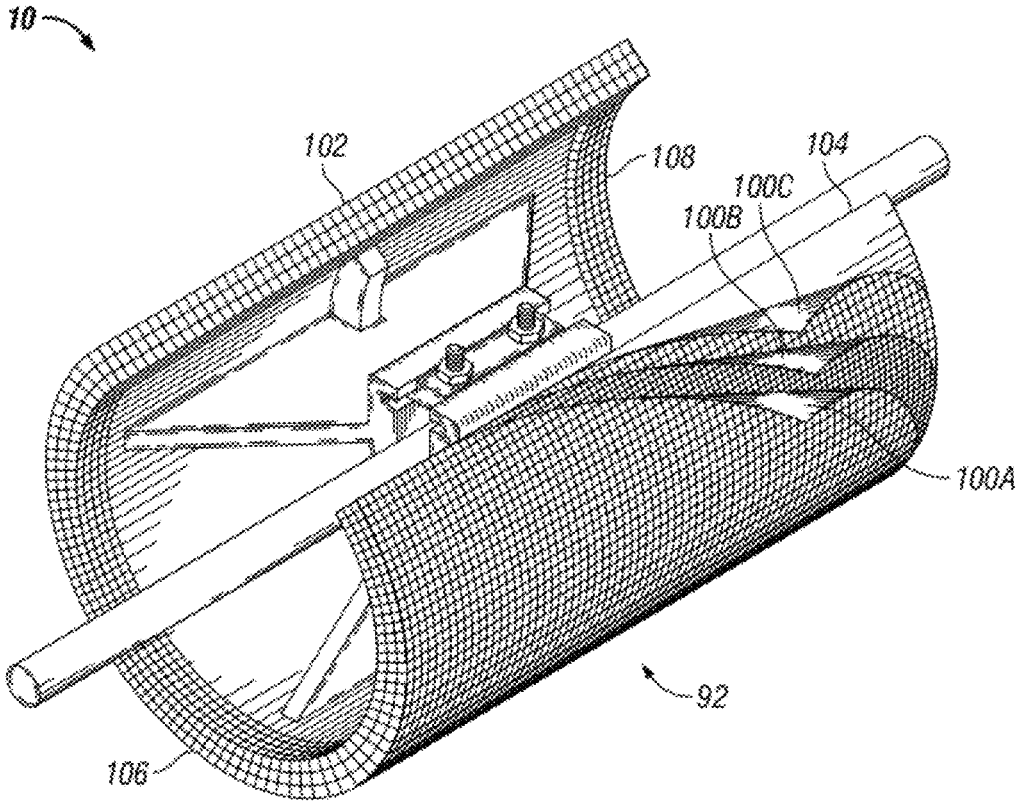
FIG. 7 is a view of a multiple layer jacket according to an embodiment of the disclosure installed on a transfer cylinder, showing several jacket layers peeled back from the transfer cylinder.

Turning now to FIG. 7, a multiple layer jacket is described. The third assembly 92 is shown attached to the transfer cylinder 10 at a gripper edge 102. In an embodiment, the flexible jackets 100-*a*, 100-*b*, and 100-*c* of the third assembly 92 are coupled together at the gripper edge 102, for example stitched together. In an embodiment, the flexible jackets 100-*a*, 100-*b*, and 100-*c* of the third assembly 92 are not coupled to each other at the tail edge 104 and may be coupled to the transfer cylinder 10, for example, by a hook-and-loop fabric strip adhered to the transfer cylinder 10. In an embodiment, the flexible jackets 100-*a*, 100-*b*, and 100-*c* may readily be peeled back, for example by detaching from a hook-and-loop fabric strip, for example to adjust the free play of the flexible jackets 100 and/or to promote ease of cleaning of the transfer cylinder 10 and/or the base cover 101 (not shown in FIG. 7). While FIG. 7 illustrates the third assembly 92, other embodiments of the multiple layer jacket may also comprise flexible jackets 100 coupled together at the gripper edge 102 and free at the tail edge 104, such that the flexible jackets 100 may be peeled back at the tail edge 104 to adjust free play of the flexible jackets 100 and/or to clean the transfer cylinder 10 and/or the base cover 101. Additionally, while the flexible jackets 100 in FIG. 7 are shown as coupled together at the gripper edge 102, in another embodiment of the multiple layer jackets, the flexible jackets 100 may be coupled together at the tail edge 104 and free at the gripper edge 102. It is understood that when installed on the transfer cylinder 10 and ready for operation of associated press unit 20, both the gripper edge 102 and the tail edge of the flexible jackets 100 are secured to the transfer cylinder 10.

While shown as extending from the operator edge 106 to the gear edge 108 of the transfer cylinder 10 in FIG. 7, in some embodiments the multiple layer jackets, for example the third assembly 92, may not extend entirely from the operator edge 106 to the gear edge 108 of the transfer cylinder 10. For example, in an embodiment, an outer margin of the transfer cylinder 10 at the operator edge 106, at the gear edge 108, or both of the operator edge 106 and the gear edge 108 may not be covered by the multiple layer jackets, for example the third assembly 92, and/or by the base cover 101.

Figure 8:
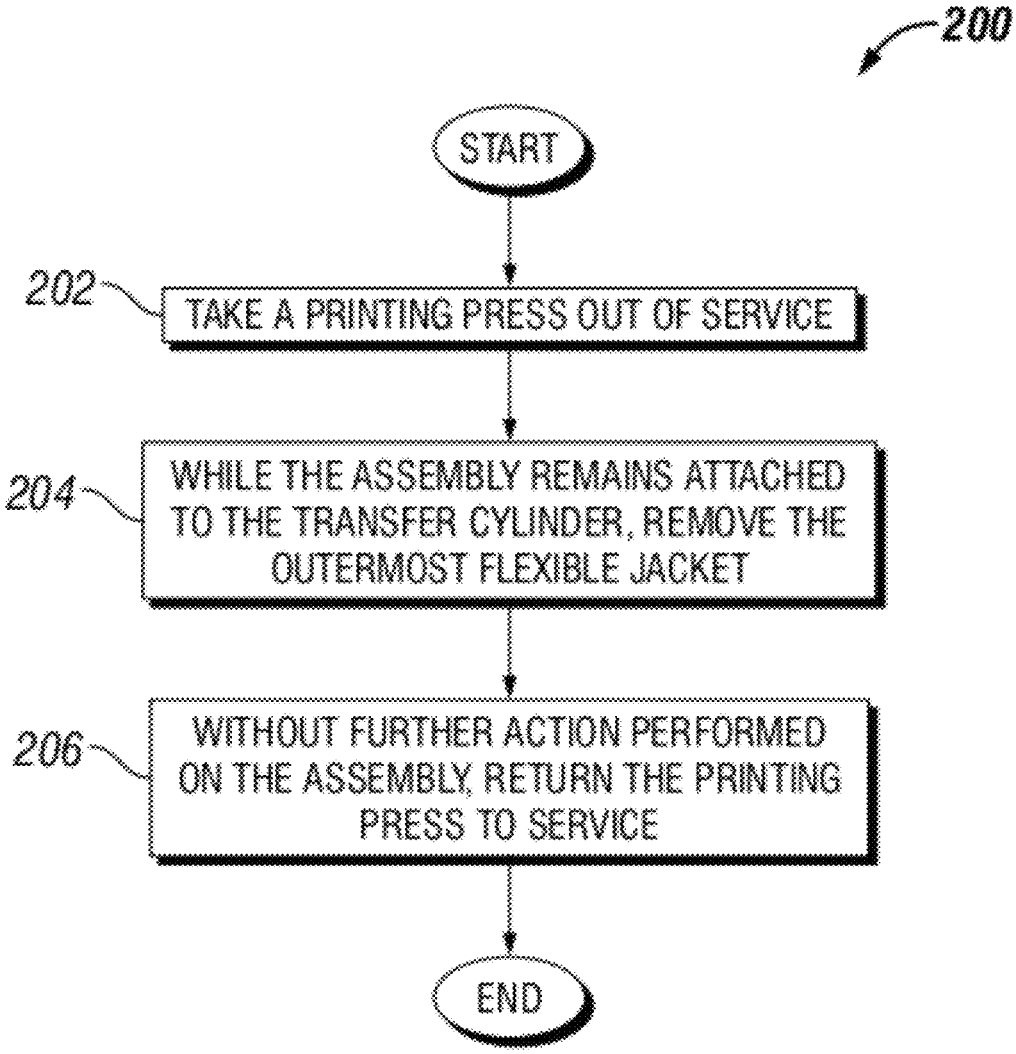
FIG. 8 is a flow chart of a method of maintaining a printing press.

Turning now to FIG. 8, a method of maintaining a printing press 12 is described. At block 202, the printing press 12 is taken out of service. At block 204, while the assembly 90-95 remains attached to the transfer cylinder 10, the outermost flexible jacket 100 is removed from the assembly 90-95. In an embodiment, the outermost flexible jacket 100 may be removed by pulling the outermost flexible jacket 100 free from the assembly 90-95, preferably at the edge or edges along which the outermost flexible jacket 100 is attached to the remaining flexible jackets 100 and/or base cover 101. A lower layer of the flexible jacket 100 having free play, the new outermost flexible jacket 100, will now be exposed and will bear the printed substrate as it passes through the printing press 12. At block 206, the printing press 12 is returned to service without performing any further action on the assembly 90-95. In an embodiment, it may be desirable to leave at least two remaining flexible jackets 100 in the assembly 92-95 while it is attached to the transfer cylinder 10 and to retire the assembly 92-95 from service rather than remove too many flexible jackets 100 from the assembly 92-95. In another embodiment, it may be desirable to leave at least three or more remaining flexible jackets 100 in the assembly 92-95 while it is attached to the transfer cylinder 10 and to retire the assembly 92-95 from service rather than remove too many flexible jackets 100 from the assembly 92-95. Leaving at least a plurality of remaining flexible jackets 100 in the assembly 92-95 may promote improved life of the flexible jackets 100 and/or improved printing quality. The at least two remaining flexible jackets 100 may be preferably attached with free play. Other actions may be performed on the printing press 12 while it is out of service, for example adjusting tolerances and or positions of mechanical assemblies, but no further actions are required with respect to the assembly 90-95.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What we claim is:

1. In a printing press having a transfer cylinder for transferring a freshly printed substrate, an anti-marking device, comprising:

an assembly of at least two flexible jackets, the assembly removably attached to the transfer cylinder so that the at least two flexible jackets have free play with respect to the transfer cylinder, wherein an outermost flexible jacket supports the freshly printed substrate as it passes over the transfer cylinder and wherein the outermost flexible jacket is removable from the assembly leaving at least one flexible jacket with free play in the assembly, while the assembly remains attached to the transfer cylinder.

2. The anti-marking device of claim 1, wherein the assembly comprises three flexible jackets.

3. The anti-marking device of claim 1, wherein the assembly comprises six flexible jackets.

4. The anti-marking device of claim 1, wherein the flexible jackets are comprised of at least one of polytetrafluoroethylene (PTFE), fluorinated ethylene propylene (FEP), and perfluoroalkoxy (PFA).

5. The anti-marking device of claim 1, wherein the flexible jackets are a woven material that is coated with fluoropolymer.

6. The anti-marking device of claim 1, wherein the flexible jacket is woven at least in part of threads manufactured using fluoropolymer.

7. The anti-marking device of claim 6, wherein the assembly further has a gripper edge and a tail edge and the assembly further comprises a tape strip along the tail edge to promote attaching the assembly to the transfer cylinder, wherein the tape strip is secured along a first face to at least the innermost flexible jacket by at least one of heat treating, pressure treating, and extruding and the second face of the tape strip comprises an adhesive.

8. The anti-marking device of claim 1, wherein the flexible jackets have at least one horizontally disposed means for visual alignment, wherein the means for visual alignment is used during at least one of attaching the flexible jackets to the transfer cylinder and adjusting the free play of the flexible jackets.

9. The anti-marking device of claim 8, wherein the at least one horizontally disposed means for visual alignment comprises a visual alignment stripe.

10. The anti-marking device of claim 9, wherein the flexible jackets comprise a woven fabric having weft threads and warp threads and wherein the visual alignment stripe is provided by the absence of one of at least one weft thread and at least one warp thread.

11. The anti-marking device of claim 9, wherein the visual alignment stripe is applied on the flexible jackets by one of a painting process, a lithographic process, a silk screen process, and a laser induced marking process.

12. The anti-marking device of claim 1, wherein the assembly further comprises a base cover, wherein the at least two flexible jackets are coupled to the base cover with free play, and the assembly is removably attached to the transfer cylinder oriented with the base cover next to the transfer cylinder.

13. The anti-marking device of claim 12, wherein the base cover is comprised of fluoropolymer.

14. The anti-marking device of claim 13, wherein the base cover is comprised of beads adhered to an outwards facing surface of the base cover.

15. The anti-marking device of claim 14, wherein the beads are one of glass beads and ceramic beads.

16. The anti-marking device of claim 1, wherein the at least two flexible jackets are attached along a portion of at least one edge.

17. The anti-marking device of claim 1, wherein the at least two flexible jackets are attached along a portion of at least two opposing edges.

18. The anti-marking device of claim 1, wherein the at least two flexible jackets are attached by adhesive, thermal bonding, or combinations thereof.

19. The anti-marking device of claim 1, wherein the flexible jackets each comprises a fabric, wherein the fabric further comprises at least one of cotton, hemp, wool, silk, linen, nylon, rayon, polyester, polyacrylate, polyolefin, polyimide, polyamide, or combinations thereof.

* * * * *